US008622097B2

(12) United States Patent
Kane et al.

(10) Patent No.: US 8,622,097 B2
(45) Date of Patent: Jan. 7, 2014

(54) SPILL CONTAINMENT APPARATUS FOR STORAGE TANKS

(75) Inventors: Kristopher A. Kane, Hamilton, OH (US); Peter E. Manger, Cincinnati, OH (US); James E. Kesterman, Cincinnati, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 710 days.

(21) Appl. No.: 12/394,171

(22) Filed: Feb. 27, 2009

(65) Prior Publication Data

US 2009/0223595 A1 Sep. 10, 2009

Related U.S. Application Data

(60) Provisional application No. 61/033,571, filed on Mar. 4, 2008.

(51) Int. Cl.
*B65B 3/04* (2006.01)

(52) U.S. Cl.
USPC ..... 141/1; 141/86; 141/311 A; 404/25; 405/52; 29/428

(58) Field of Classification Search
USPC ..... 141/86, 311 A, 1, 11, 369, 374; 404/25; 405/53, 52; 137/312; 285/142.1, 95; 29/428
See application file for complete search history.

(56) References Cited

U.S. PATENT DOCUMENTS 4,278,115 A 7/1981 Briles et al.
4,491,147 A 1/1985 Argandona
4,501,305 A 2/1985 Zola et al.
4,520,852 A 6/1985 Klein
4,527,708 A 7/1985 Dundas et al.
4,579,155 A 4/1986 Zola
4,593,714 A 6/1986 Madden
4,615,362 A 10/1986 Hartman et al.
4,655,361 A 4/1987 Clover et al.
4,659,251 A 4/1987 Petter et al.
4,696,330 A * 9/1987 Raudman et al. ..... 141/86
4,706,718 A 11/1987 Milo
4,717,036 A 1/1988 Dundas et al.
4,762,440 A 8/1988 Argandona
4,763,806 A 8/1988 Podgers et al.

(Continued)

OTHER PUBLICATIONS

Michiel Desittere; International Search Report and Written Opinion issued in related PCT application No. PCT/US2009/035678; Jan. 28, 2010; 15 pages; European Patent Office.

(Continued)

*Primary Examiner* — Timothy L Maust
*Assistant Examiner* — Timothy P Kelly
(74) *Attorney, Agent, or Firm* — Wood, Herron & Evans, LLP

(57) ABSTRACT

A spill containment apparatus includes a container adapted to be coupled to an end of a riser pipe of a storage tank and having a proximal end and a distal end. A tubular socket is formed in the container adjacent its distal end for receiving the riser pipe therein. The socket includes a securing mechanism for securing the container to the riser pipe, wherein the securing mechanism is spaced proximally of the distal end of the container to define the socket. The socket is configured to allow the riser pipe to support and balance the container during coupling of the container to the riser pipe.

15 Claims, 6 Drawing Sheets

(56) References Cited

U.S. PATENT DOCUMENTS

| | | | | |
|---|---|---|---|---|
| 4,770,317 | A | 9/1988 | Podgers et al. | |
| 4,793,387 | A | 12/1988 | LeBlanc et al. | |
| 4,807,675 | A | 2/1989 | Sharp | |
| 4,809,866 | A | 3/1989 | Crocker | |
| 4,842,163 | A | 6/1989 | Bravo | |
| 4,842,443 | A | 6/1989 | Argandona | |
| 4,856,564 | A | 8/1989 | Obal | |
| 4,881,579 | A | 11/1989 | Sharp | |
| 4,896,705 | A | 1/1990 | Podgers et al. | |
| 4,958,957 | A | 9/1990 | Berg et al. | |
| 4,960,346 | A | 10/1990 | Tamayo | |
| 4,968,066 | A * | 11/1990 | Adams | 285/142.1 |
| 4,971,225 | A | 11/1990 | Bravo | |
| 5,052,217 | A | 10/1991 | Sharp | |
| 5,058,633 | A | 10/1991 | Sharp | |
| 5,085,257 | A | 2/1992 | Smith | |
| 5,098,221 | A | 3/1992 | Osborne | |
| 5,114,271 | A | 5/1992 | Sunderhaus et al. | |
| 5,117,877 | A | 6/1992 | Sharp | |
| 5,186,222 | A | 2/1993 | Brand | |
| 5,217,052 | A | 6/1993 | Sharp | |
| 5,222,832 | A | 6/1993 | Sunderhaus et al. | |
| 5,295,535 | A | 3/1994 | Boles et al. | |
| 5,372,453 | A | 12/1994 | Argandona | |
| 5,544,974 | A | 8/1996 | Berg et al. | |
| 5,553,971 | A | 9/1996 | Osborne | |
| 5,564,858 | A | 10/1996 | Bravo | |
| 5,567,083 | A | 10/1996 | Osborne | |
| 5,590,981 | A | 1/1997 | Osborne | |
| 5,664,951 | A * | 9/1997 | Clary et al. | 439/92 |
| 5,775,842 | A | 7/1998 | Osborne | |
| 5,882,045 | A | 3/1999 | Bravo | |
| 5,944,361 | A | 8/1999 | Bravo | |
| 5,954,103 | A | 9/1999 | Smith | |
| 5,967,174 | A | 10/1999 | MacDonald | |
| 5,975,110 | A | 11/1999 | Sharp | |
| 5,992,680 | A | 11/1999 | Smith | |
| 6,238,137 | B1 | 5/2001 | Whitworth et al. | |
| 6,267,156 | B1 | 7/2001 | Argandona | |
| 6,523,581 | B2 | 2/2003 | Pendleton et al. | |
| 6,527,476 | B1 | 3/2003 | Pettesch | |
| 6,558,077 | B1 | 5/2003 | Colson | |
| 6,655,418 | B1 | 12/2003 | McGill et al. | |
| 6,719,489 | B1 | 4/2004 | Colson | |
| 6,742,550 | B2 | 6/2004 | Caparros | |
| 6,840,293 | B1 | 1/2005 | Smith | |
| 6,840,549 | B1 | 1/2005 | Smith | |
| 6,939,081 | B1 | 9/2005 | Gropp | |
| 6,971,419 | B1 | 12/2005 | Lessley | |
| 6,986,622 | B2 | 1/2006 | Ageheim et al. | |
| 7,069,965 | B2 | 7/2006 | Pendleton et al. | |
| 7,171,994 | B1 | 2/2007 | O'Brien | |
| 2002/0005225 | A1 | 1/2002 | Caparros | |
| 2002/0179178 | A1 | 12/2002 | Pendleton | |
| 2004/0228686 | A1 | 11/2004 | Argandona | |
| 2005/0169710 | A1 | 8/2005 | Folkers | |
| 2007/0144606 | A1 | 6/2007 | O'Brien | |
| 2008/0023075 | A1 * | 1/2008 | Bravo et al. | 137/312 |

OTHER PUBLICATIONS

Paulina Danissen; Partial International Search Report issued in counterpart PCT Application No. PCT/US2009/035678 (5 pages).

* cited by examiner

SPILL CONTAINMENT APPARATUS FOR STORAGE TANKS

CROSS-REFERENCE TO RELATED APPLICATIONS

This application claims the benefit of U.S. Provisional Patent Application Ser. No. 61/033,571, filed Mar. 4, 2008 (pending), the disclosure of which is fully incorporated by reference herein.

TECHNICAL FIELD

The invention relates to fuel dispensing systems and, more particularly, to a spill containment apparatus to reduce or eliminate the likelihood of fuel spilling into the environment during a fuel tank fill operation.

BACKGROUND

Fuel dispensing systems used at retail gas stations typically include an underground storage tank containing gasoline, diesel fuel, or other liquid fuel, an above-ground dispensing unit terminating in a nozzle adapted to supply the fuel to a motor vehicle, and a piping system interconnecting the underground storage tank and dispensing unit. As fuel is dispensed to motor vehicles, it becomes necessary to refill or re-supply the underground storage tank with fuel. To this end, the underground storage tank includes a riser pipe having a distal end in communication with the storage tank and a proximal end adjacent the surface of the ground. The proximal end of the riser pipe includes known structure for coupling with an end of a supply hose coupled to a tanker truck carrying a supply of fuel. Fuel from the tanker truck is then permitted to flow through the supply hose, through the riser pipe, and into the storage tank so as to refill the storage tank with fuel.

During such fill operations, it is not uncommon for fuel to spill from, for example, the supply hose and/or the riser pipe in the area immediately adjacent the proximal end of the riser pipe. To prevent the spilled fuel from leaking into the environment around the fuel dispensing system, a spill container, commonly referred to as a spill bucket, may be disposed about the proximal end of the riser pipe. The spill bucket is adapted to contain any spilled fuel from such a fill operation and direct the fuel to the storage tank.

Conventional spill buckets typically include a containment housing having a distal end coupled to the proximal end riser pipe in a fluid tight manner. A proximal end of the containment housing is adjacent the surface of the ground and includes a removable cover for accessing the proximal end of the riser pipe during a fill operation. The distal end of the containment housing typically includes a drain that provides selective fluid communication between an interior cavity of the containment housing and the storage tank. In this way, fuel that inadvertently spills during a fill operation is collected in the interior cavity of the containment housing and directed to the storage tank by actuation of the drain.

While such spill buckets are generally effective for containing inadvertent fuel spillage during fill operations, manufacturers continually strive to provide improved components of a fuel dispensing system. Thus, manufacturers strive to provide components that are relatively easy to install during, for example, an initial installation, or during a repair or replacement process. By way of example, repair and/or replacement of a conventional spill bucket is typically difficult, time consuming and labor intensive.

In addition, many state and/or federal regulations are requiring redundancy in hazardous material handling systems, including fuel dispensing systems. Many spill bucket designs, however, only provide for a single containment housing. Existing spill bucket designs having a double-walled structure that provide containment redundancy suffer from the same shortcomings as described above, i.e., repair and/or replacement is typically difficult, time consuming, and labor intensive.

Accordingly, there is a need for a spill containment apparatus that provides for improved installation and/or containment redundancy such that personnel may make timely replacements, repairs, or perform other maintenance in a simplified, cost effective, time-efficient, and labor-efficient manner.

SUMMARY

To address these and other shortcomings in the art, a spill containment apparatus for containing liquid spillage from a fill operation is provided. The spill containment apparatus includes a container adapted to be coupled to an end of a riser pipe of a storage tank having a proximal end and a distal end. A tubular socket is formed in the container adjacent its distal end for receiving the riser pipe therein. The socket includes a securing mechanism, such as, for example, threads, for securing the container to the riser pipe, wherein the securing mechanism is spaced proximally of the distal end of the container to define the socket. The socket is configured to allow the riser pipe to support and balance the container during coupling of the container to the riser pipe.

In one embodiment, the containment apparatus includes a primary spill container and a secondary spill container to provide redundancy to liquid spillage containment. The primary container may include a primary body and a primary base. Similarly, the second container may include a secondary body and a secondary base. The secondary base is configured to be coupled to the riser pipe and the primary base is configured to be coupled to the secondary base. The containment apparatus may still further include an outer sump housing adapted to contain at least in part the primary and secondary containers and having a cover for accessing the riser pipe.

In another embodiment, a spill containment apparatus for containing liquid spillage from a fill includes a container adapted to be coupled to an end of a riser pipe of a storage tank and a nipple adapted to carry access structure for accessing the riser pipe with a supply hose. An adaptor is provided and includes a first end configured to be removably coupled to the container, and a second end configured to be coupled to the nipple. The nipple may be assembled to or removed from the container by respectively coupling or removing the adaptor from the container. The adaptor may be coupled to the container using one or more fasteners easily accessed by a tool for manipulation. For example, the fasteners may be threaded bolts having an axis generally parallel to the axis of the container. The access structure may include at least one of an adaptor (e.g., swivel adaptor) and a cap.

In this embodiment, the containment apparatus may include a primary spill container and a secondary spill container to provide redundancy to liquid spillage containment. The primary container may include a primary body and a primary base. Similarly, the second container may include a secondary body and a secondary base. The secondary base is configured to be coupled to the riser pipe and the primary base is configured to be coupled to the secondary base. The containment apparatus may still further include an outer sump housing adapted to contain at least in part the primary and secondary containers and have a cover for accessing the riser pipe.

A method of assembling a spill containment apparatus for containing liquid spillage from a fill operation includes coupling a container to an end of a riser pipe of a storage tank, coupling a nipple to a removable adaptor external of the container (i.e., while not being disposed in the container), and then coupling the adaptor to the container. Such a modular design facilitates installation and maintenance. For example, maintenance may be performed by removing the adaptor carrying the nipple from the container, exposing a component of the containment apparatus, and effecting repair and/or replacement of the component. The adaptor (and nipple) may then be re-connected to the container.

In still another embodiment, a spill containment apparatus includes a container adapted to be coupled to an end of a riser pipe of a storage tank. A fill tube is disposed in the riser pipe and has an end that extends beyond or proximally of the end of the riser pipe. The fill tube is supported at least in part by engagement of the fill tube with the container. More particularly, in one embodiment, the fill tube includes a flange and the container includes a seat, wherein the flange is disposed in the seat. The seat may be smooth and devoid of any irregularities so as to facilitate sealing between the fill tube and the container.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
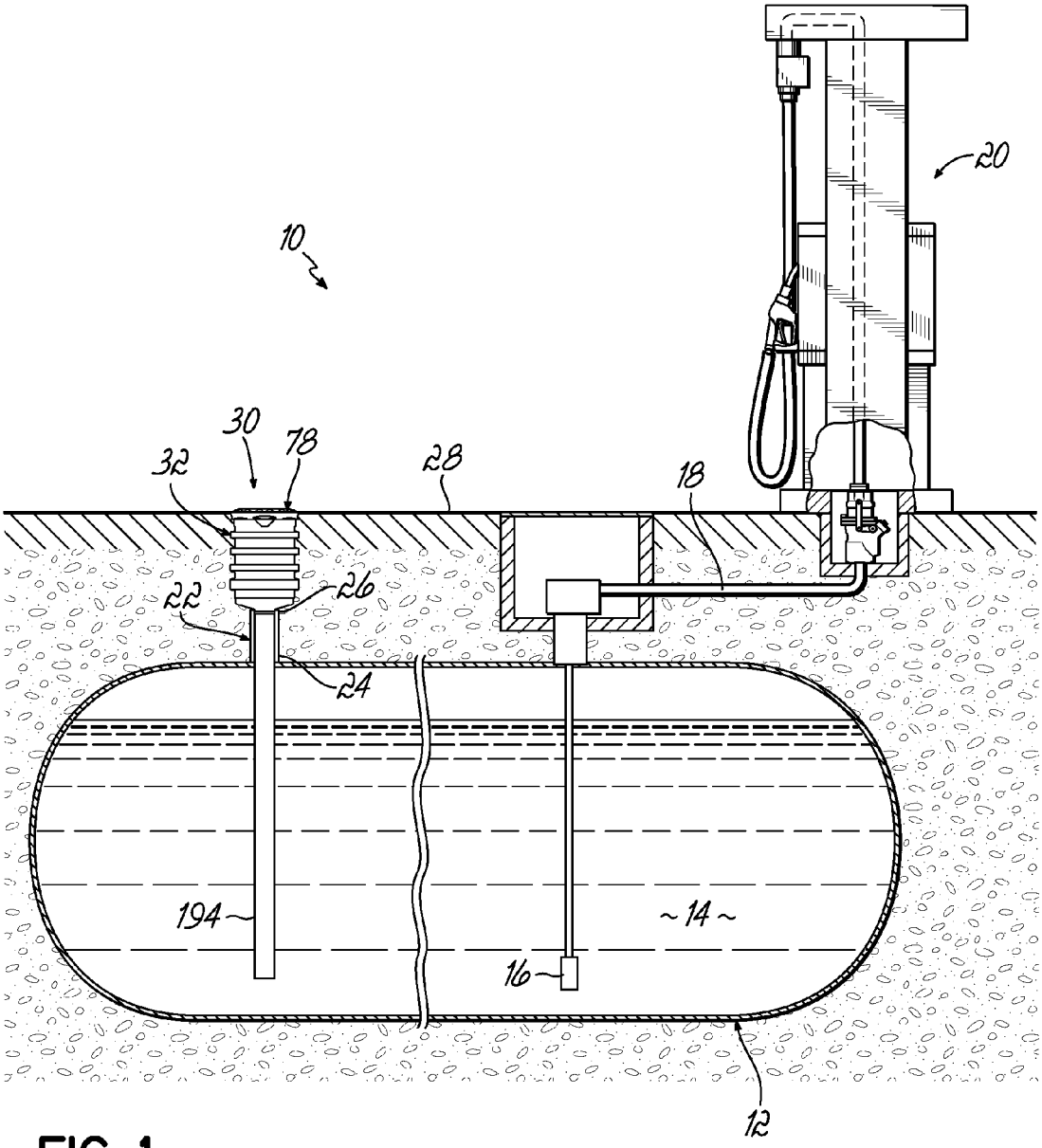
FIG. 1 is a schematic illustration of a fuel dispensing system incorporating a spill bucket in accordance with an embodiment of the invention.

With reference to FIG. 1, an exemplary fuel dispensing system 10 is shown and generally includes an underground storage tank 12 for storing fuel 14, and a submersible pump 16 located within tank 12 and coupled to a fluid conduit line 18 that transports the fuel 14 under pressure to one or more dispensers 20. The fuel dispensing system 10 also generally includes a riser pipe 22 for filling or re-filling the storage tank 12 with fuel 14. The riser pipe 22 includes a distal end 24 in fluid communication with the storage tank 12 and a proximal end 26 adjacent, but below the ground 28. A spill containment apparatus, referred to herein as a spill bucket 30, in accordance with aspects of the invention is disposed about the proximal end 26 of riser pipe 22 for containing any fuel spilled during a fill operation of storage tank 12.

Figure 2:
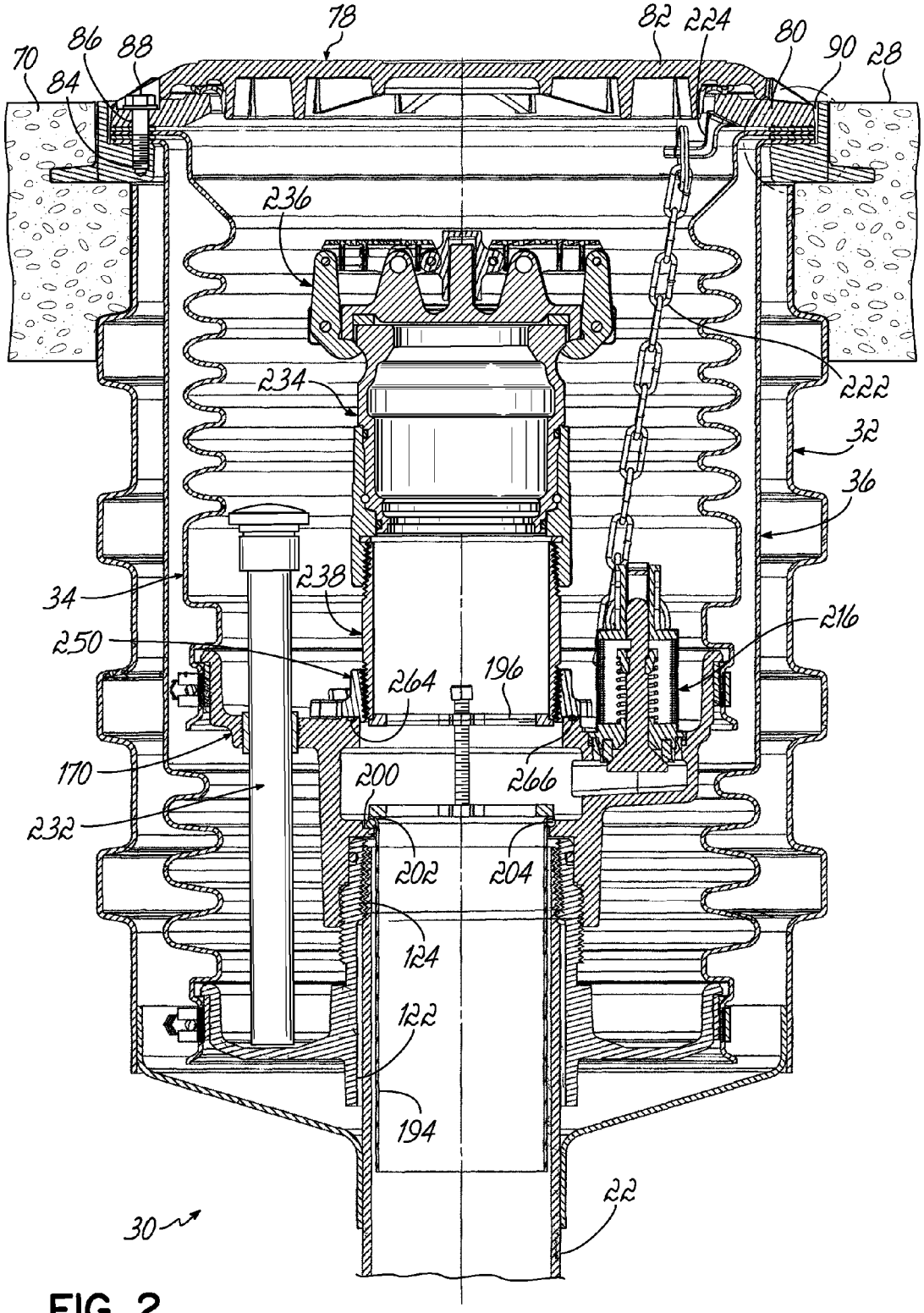
FIG. 2 is a cross-sectional view of an exemplary spill bucket in accordance with an embodiment of the invention.

An exemplary embodiment of spill bucket 30 in accordance with aspects of the invention is shown in FIG. 2. The spill bucket 30 includes an outer sump housing 32, a primary spill container 34, and a secondary spill container 36. The primary and secondary spill containers 34, 36 provide redundancy to spill containment of fuel 14 during a fill operation to meet the requirements of those jurisdictions mandating double-walled protection. In addition, and as discussed in more detail below, the design of spill bucket 30 provides a number of advantages in regard to installing, replacing and/or repairing the spill bucket 30.

Figure 3:
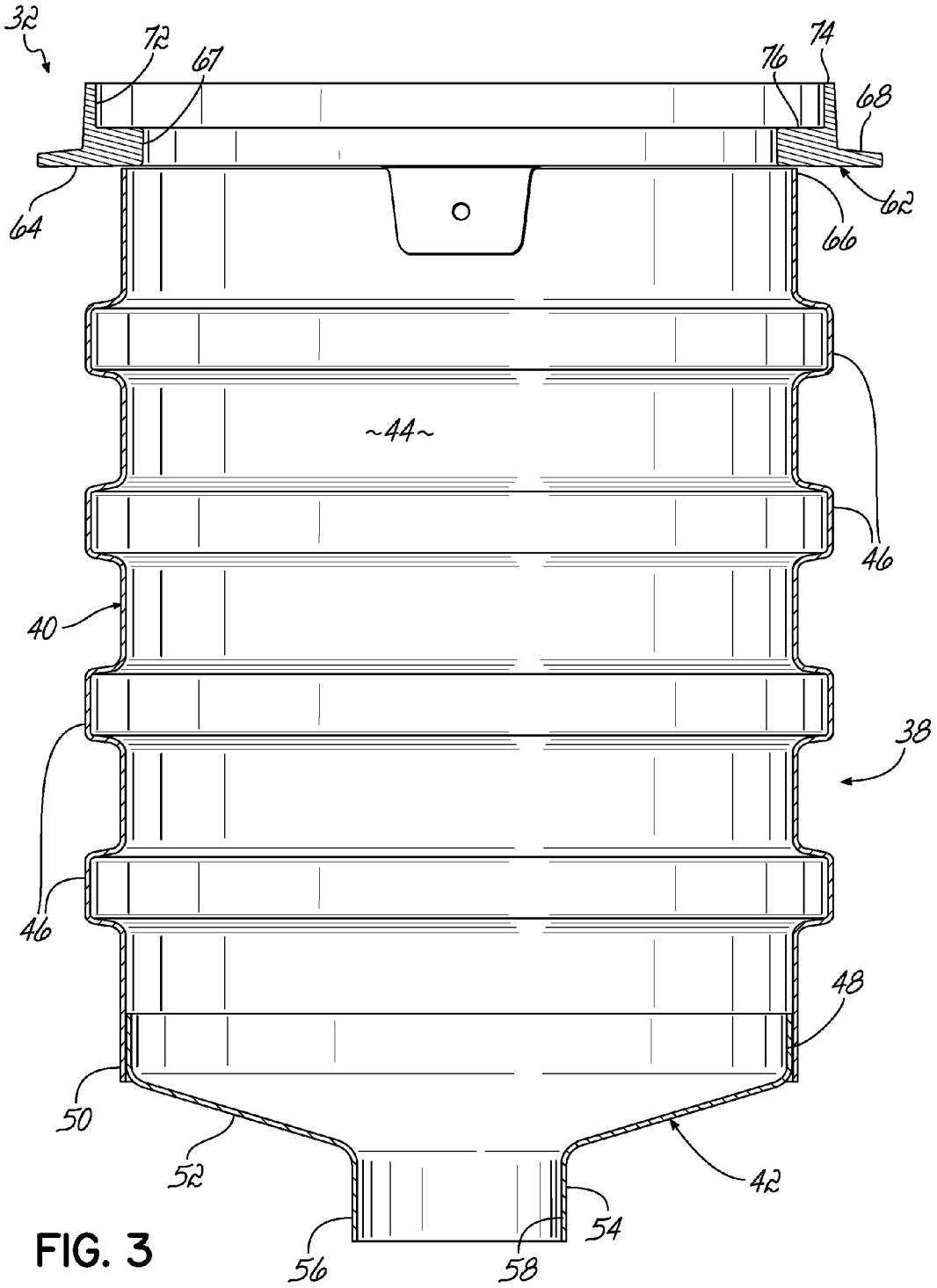
FIG. 3 is a cross-sectional view of the outer housing shown in the spill bucket of FIG. 2.

As shown in FIG. 3, the outer sump housing 32 includes a generally cylindrical body 38 having a side wall 40 and a bottom guard 42 that collectively define an interior cavity 44. In one embodiment, the side wall 40 and bottom guard 42 may have a two-piece construction, but alternatively may be formed as a one-piece construction (not shown). Moreover, the body 38 (e.g., side wall 40 and bottom guard 42) may be formed from a suitable material including various engineering plastics such as polyethylene. Those of ordinary skill in the art may recognize other suitable materials for body 38. The side wall 40 may include a plurality of ribs 46 extending outwardly therefrom so as to facilitate securement of the outer sump housing 32 in the ground (e.g., dirt, gravel, etc.). A proximal end 48 of the bottom guard 42 is coupled to a distal end 50 of the side wall 40 and includes a slanted bottom surface 52 that terminates in a distally-directed collar 54 at the distal end 56 of the bottom guard 42. Collar 54 includes an opening 58 that receives the riser pipe 22 therethrough such that the proximal end 26 thereof is disposed in the interior cavity 44 (FIG. 2). The opening 58 in collar 54 is sized larger than the riser pipe 22 to define a slight gap therebetween (not shown). As explained in more detail below, the slanted surface 52 and gap facilitate the flow and escape of water from the sump housing 32 and to the environment.

The outer sump housing 32 further includes a generally annular skirt 62 having a distal end 64 coupled to the proximal end 66 of the side wall 40 and defining an opening 67 providing access to interior cavity 44. The skirt 62 is adapted to support the spill bucket 30 adjacent the ground 28. In this regard, skirt 62 includes a radially-extending outer shoulder 68 adapted to receive a drive surface 70 (e.g., concrete, asphalt, etc.) on the ground 28 (FIG. 2). In this way, the skirt 62 (and therefore the outer sump housing 32) is effectively fixedly secured in the ground 28 and may only be removed by first removing the drive surface 70 away from the skirt 62. In one embodiment, the outer shoulder 68 extends around the full periphery of skirt 62. In an alternate embodiment, however, skirt 62 may include a plurality of circumferentially spaced, radially-extending tabs that define the outer shoulder 68. Skirt 62 may be formed from a suitable material including ductile iron, for example, or other materials known to those of ordinary skill in the art.

Skirt 62 further includes a bore 72 in the proximal end 74 that terminates in a radially-extending inner shoulder 76. As explained in more detail below, inner shoulder 76 is adapted to support at least in part the primary and secondary spill containers 34, 36. In addition, and as illustrated in FIG. 2, bore 72 may be further adapted to receive a cover 78 for providing selective access to the proximal end 26 of riser pipe 22 located in interior cavity 44. In one embodiment, cover 78 may include a mounting ring 80 secured to skirt 62 and a removable cover plate 82 positioned atop mounting ring 80. In this regard, the skirt 62 may include a plurality of circumferentially spaced threaded bores 84 and the mounting ring 80 may include a corresponding number of bores 86 so as to receive a threaded fastener 88 when aligned. The cover 78 may be formed from a suitable material including cast iron, aluminum, ductile iron, for example, or other materials known to those of ordinary skill in the art.

To access the proximal end 26 of the riser pipe 22, an operator may remove the cover plate 82 from the mounting ring 80, which may be positioned on mounting ring 80 only by its weight. In one embodiment, the outer cross dimension of the bore 72 is larger than the outer cross dimension of the cover 78 so as to provide a gap 90 therebetween. The gap 90 allows water on the driving surface 70 and/or cover 78, for example, to drain to the environment through the sump housing 32.

Figure 4:
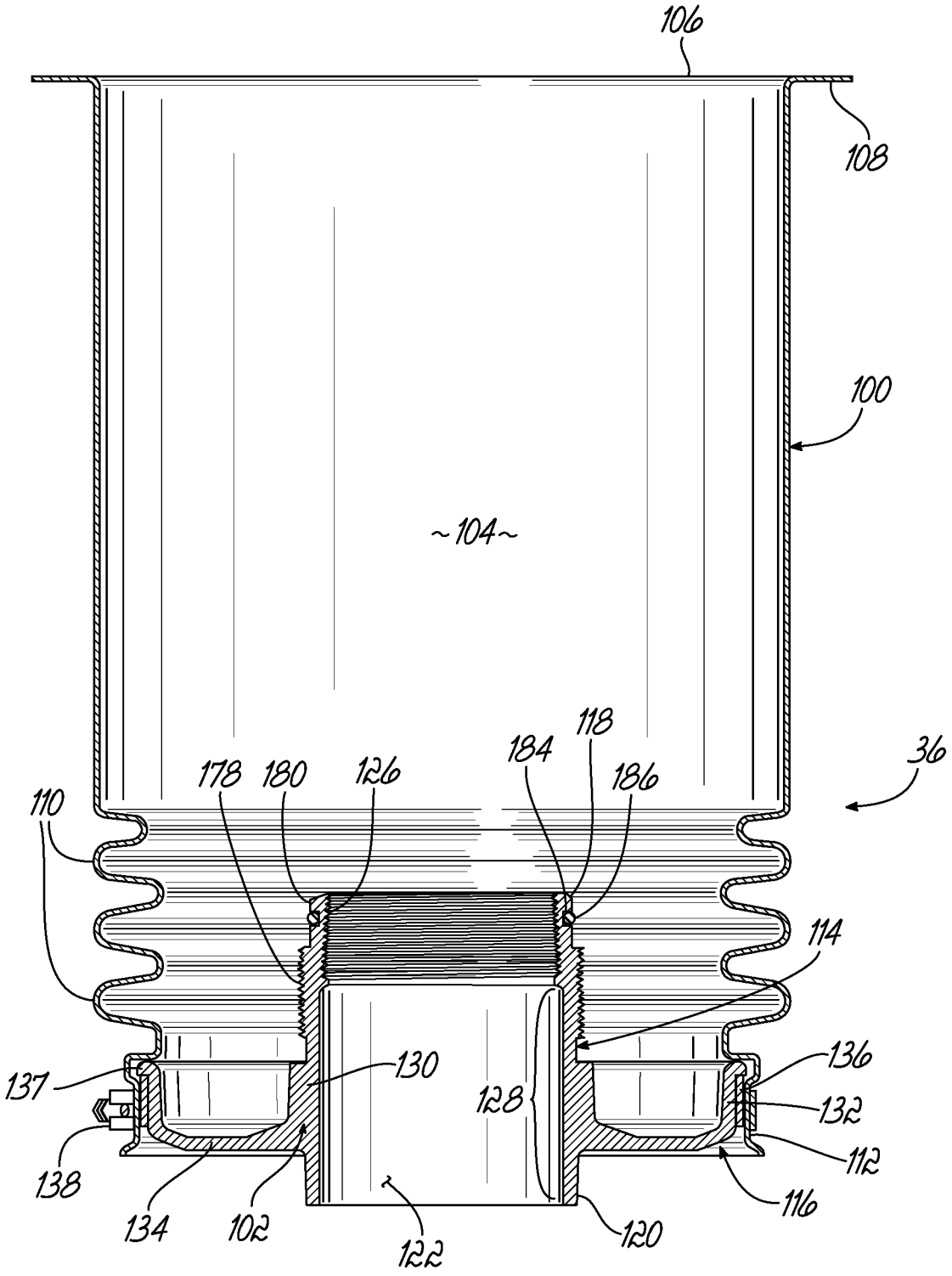
FIG. 4 is a cross-sectional view of the secondary spill container shown in the spill bucket of FIG. 2.

In reference to FIGS. 2 and 4, the secondary spill container 36 may be disposed in the interior cavity 44 of the sump housing 32. The secondary spill container 36 includes a generally cylindrical secondary body 100 and a secondary base 102 that collectively define a secondary interior cavity 104. The secondary body 100 includes a proximal end 106 having an outwardly, radially-extending flange 108 that engages inner shoulder 76 of skirt 62 to at least partially support secondary spill container 36. Flange 108 may engage inner shoulder 76 in a manner that allows water to flow therebetween (i.e., is not fluid tight). In this way, any water that drains into gap 90 between the cover 78 and bore 72 is permitted to flow into the interstitial space between the secondary spill container 36 and outer sump housing 32 and to the environment via the gap between the collar 54 and riser pipe 22. In one embodiment, at least a portion of the secondary body 100 may have one or more bellows 110 that provide some expansion and/or contraction of the secondary body 100. Such a construction may be desirable to accommodate naturally occurring or other ground movement (e.g., frost heave). The secondary body 100 may be formed from a suitable material including various engineering plastics such as polyethylene. Those of ordinary skill in the art may recognize other suitable materials for secondary body 100. The secondary body 100 also includes a distal end 112, which is coupled to the secondary base 102, as will now be described.

The secondary base 102 includes a central tube 114 and an annular, radially-extending basin 116 that facilitates coupling of the secondary spill container 36 with the riser pipe 22. The secondary base 102 may be formed from a suitable material including cast iron, ductile iron, other metals, composites, for example, or other materials known to those of ordinary skill in the art. The central tube 114 includes a proximal end 118, distal end 120, and a passageway 122 extending therebetween adapted to receive the riser pipe 22 therein. To this end, the proximal end 26 of the riser pipe 22 includes a set of external threads 124 (FIG. 2). Central tube 114 includes a corresponding set of internal threads 126 that cooperate with threads 124 to threadably couple secondary base 102 with riser pipe 22 (FIG. 2). As illustrated in FIGS. 2 and 4, in one embodiment, the internal threads 126 on central tube 114 may be located adjacent the proximal end 118 thereof. In this way, when so coupled, the proximal end 26 of the riser pipe 22 is located proximal of the distal end 120 of central tube 114 such that at least a portion of central tube 114 is disposed about a lateral side wall portion of the riser pipe 22 distal of the proximal end 26. Such a configuration, in effect, creates a distally-extending socket 128 relative to threads 126 for receiving the riser pipe 22 therein.

In one embodiment, basin 116 may be coupled to central tube 114 adjacent the distal end 120 thereof and distal of internal threads 126. The basin 116 may be a separate component that is fixedly secured to the central tube 114 (not shown), or alternatively, the basin 116 may be integrally formed with central tube 114 in a one-piece construction. As illustrated in FIG. 4, basin 116 has a generally U-shaped configuration with an inner leg 130 coupled to the central tube 114 and a proximally-extending outer leg 132 spaced therefrom by a bottom wall 134. Outer leg 132 includes an outer bearing surface 136 for coupling with the distal end 112 of the secondary body 100 in a fluid tight manner. By way of example, the secondary body 100 may be coupled to secondary base 102 via a band clamp 138. Outer leg 132 may further include a hook portion 137 to prevent the band clamp 138 from slipping or otherwise coming off of outer leg 132. Those of ordinary skill in the art will recognize other fasteners for coupling the secondary body 100 with the secondary base 102 in a fluid tight manner.

Figure 5:
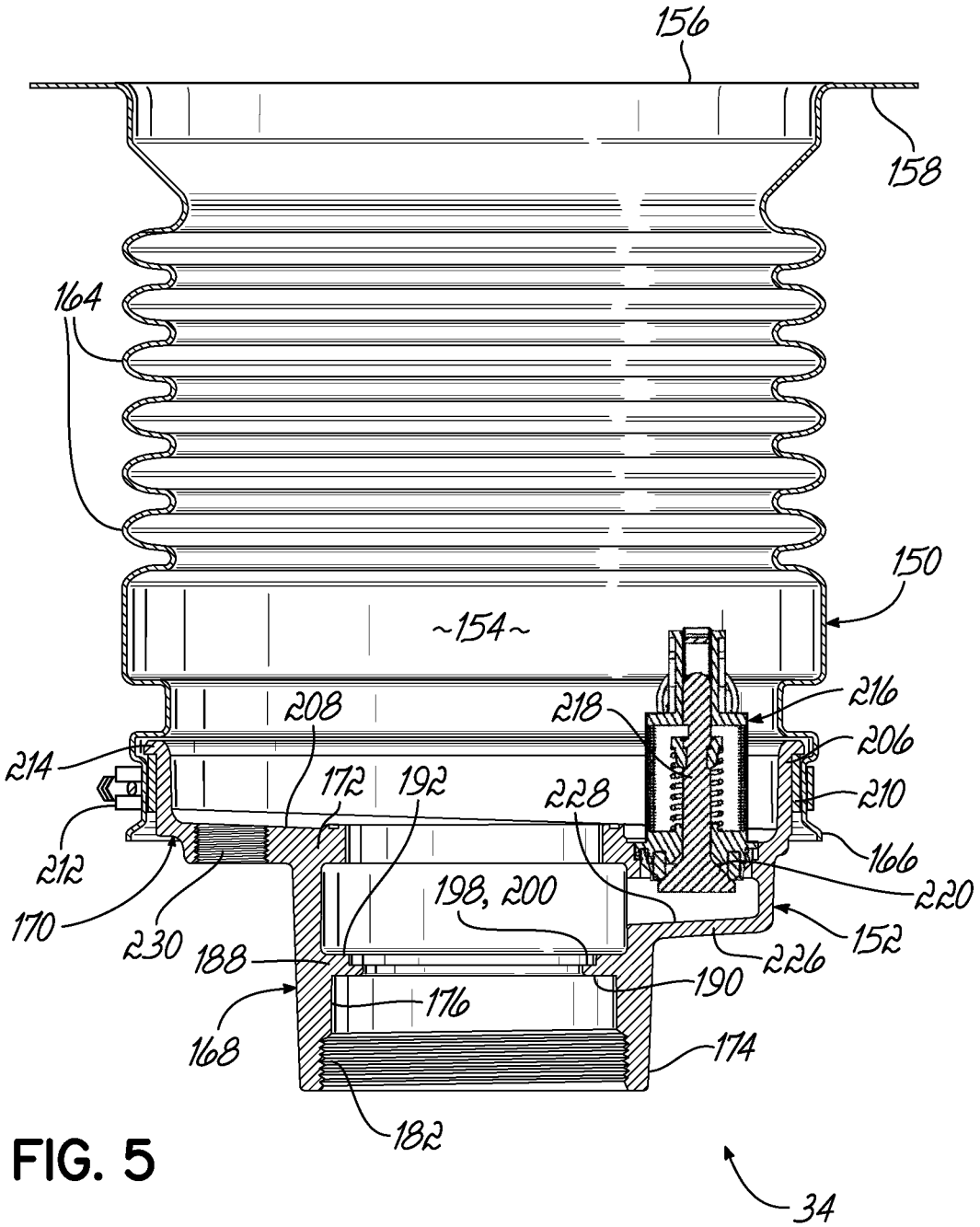
FIG. 5 is a cross-sectional view of the primary spill container shown in the spill bucket of FIG. 2.
Figure 6:
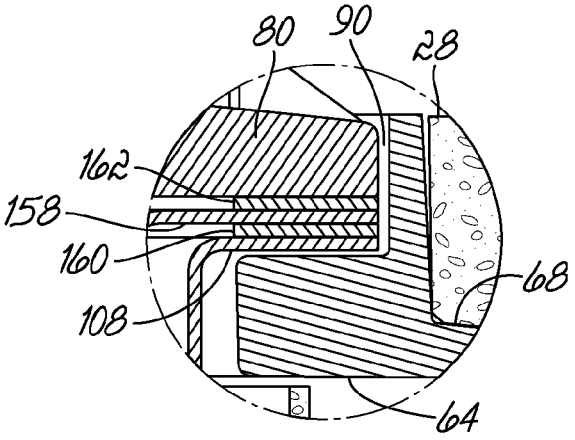
FIG. 6 is an enlarged view of the circled portion 6 shown in FIG. 2.

To provide redundancy to spill containment, and as illustrated in FIGS. 2 and 5, the primary spill container 34 may be disposed in the interior cavity 104 of the secondary spill container 36. The primary spill container 34 has a construction similar to the secondary spill container 36 and includes a generally cylindrical primary body 150 and a primary base 152 that collectively define a primary interior cavity 154. The primary body 150 includes a proximal end 156 having an outwardly, radially extending flange 158 that engages flange 108 of the secondary spill container 36 to at least partially support primary spill container 34. As illustrated in FIG. 6, a seal 160 (e.g., gasket) may be disposed between flanges 108, 158 of secondary and primary spill containers 36, 34, respectively, to keep fluid from flowing into and/or out of the interstitial space between the primary and secondary spill containers 34, 36 along a flow path between the flanges 108, 158. Additionally, a seal 162 may be provided between flange 158 and mounting ring 80 of cover 78 to similarly prevent fluid from flowing into and/or out of the primary interior cavity 154 along a flow path between flange 158 and cover 78. In one embodiment, at least a portion of the primary body 150 may have one or more bellows 164 that provide some expansion and/or contraction of the primary body 150. Similar to above, such a construction may be desirable to accommodate various ground movement. The primary body 150 may be formed from a suitable material including various engineering plastics such as polyethylene. Those of ordinary skill in the art may recognize other suitable materials for primary body 150. The primary body 150 further includes a distal end 166, which is coupled to the primary base 152, as will now be described.

The primary base 152 has a construction similar to the secondary base 102 and includes a central tube 168 and an annular, radially-extending basin 170 that facilitates coupling of the primary spill container 34 with the riser pipe 22. The primary base 152 may be formed from a suitable material including cast iron, ductile iron, other metals, composites, for example, or other materials known to those of ordinary skill in the art. The central tube 168 includes a proximal end 172, a distal end 174, and a passageway 176 extending therebetween. As illustrated in FIG. 2, the primary base 152 couples to the riser pipe 22 via the secondary base 102. In this regard, secondary base 102 includes a set of external threads 178 adjacent the proximal end 118 of central tube 114 (FIG. 4). In one embodiment, for example, the external threads 178 may be spaced from the proximal end 118 so as to present a smooth-walled entry portion 180 extending proximally of threads 178 (FIG. 4). Central tube 168 includes a corresponding set of internal threads 182 that cooperate with threads 178 to threadably couple primary base 152 with riser pipe 22 via secondary base 102. In one embodiment, the internal threads 182 on central tube 168 may be located adjacent the distal end 174 thereof such that, for example, entry portion 180 on the proximal end 118 of central tube 114 is received within passageway 176 just proximal of internal threads 182. The proximal end 118 of central tube 114 may include an annular groove 184 for receiving a seal, such as an O-ring 186 or other known seal, to provide a fluid tight connection between the primary and secondary bases 152, 102 (FIGS. 2 and 4).

In the exemplary embodiment shown in FIGS. 2 and 5, the primary base 152 also includes an annular, radially-extending ring 188 that extends into passageway 176. The ring 188 defines a distally facing shoulder 190 that confronts the proximal end 118 of central tube 114. In one embodiment, the proximal end 118 of central tube 114 may engage shoulder 190 and operate as a stop for distal movement of the primary base 152 relative to the secondary base 102. In an alternative embodiment, however, the proximal end 118 of central tube 114 may be spaced from the shoulder 190. Ring 188 also defines a proximally facing shoulder 192 configured to support one or more conventional components typically used on the liquid product side (as opposed to the vapor side) of a fill operation. Those of ordinary skill in the art will recognize such components as including fill tube 194 and jack screw 196 disposed in passageway 176 and supported by ring 188 (FIG. 2). As is known in the art, the fill tube 194 is coaxially disposed within riser pipe 22 and extends into storage tank 12 as shown in FIG. 1. Fill tube 194 provides the conduit or passageway for fuel flowing through riser pipe 22 and into storage tank 12. In this regard, shoulder 192 includes a notch 198 that defines a seat 200 that receives a flange 202 of fill tube 194 (FIG. 2). An O-ring 204 or other known seal may be disposed between flange 202 and seat 200 to provide a fluid tight connection therebetween (FIG. 2). Those of ordinary skill in the art will recognize that such components may be omitted when spill bucket 30 is used on the vapor side of the fill operation.

The basin 170 may be coupled to the central tube 168 adjacent the proximal end 172 thereof. The basin 170 may be a separate component that is fixedly secured to the central tube 168 (not shown), or alternatively, the basin 170 may be integrally formed with the central tube 168 as a one-piece construction. As illustrated in FIGS. 2 and 4, basin 170 has a generally L-shaped configuration with a proximally-extending outer leg 206 spaced from central tube 168 by a bottom wall 208. Outer leg 206 includes an outer bearing surface 210 for coupling with the distal end 166 of the primary body 150 in a fluid tight manner. By way of example, primary body 150 may be coupled to primary base 152 via a band clamp 212. Outer leg 206 may include a hook portion 214 to prevent the band clamp 212 from slipping or otherwise coming off of outer leg 206. Those of ordinary skill in the art will recognize other fasteners for coupling the primary body 150 with the primary base 152 in a fluid tight manner.

In reference to FIGS. 2 and 5, the primary spill container 34 includes a drain valve 216 for selectively providing a fluid flow path from the primary interior cavity 154 to the fill tube 194 disposed in riser pipe 22. In this regard, the drain valve 216 may be disposed in the bottom wall 208 of primary base 152. The drain valve 216 may be of a conventional design known to those of ordinary skill in the art and commercially available from OPW of Cincinnati, Ohio. The drain valve 216 generally includes a spring-biased valve element 218 urged against a valve seat 220 in a normally closed position. In the closed position, no fluid may flow between the primary interior cavity 154 and the fill tube 194 through the drain valve 216. Drain valve 216 may be selectively actuated so as to move the valve element 218 against the bias of the spring and away from valve seat 220 to an open position. When so actuated and in the open position, a fluid flow path is established between the primary interior cavity 154 and the fill tube 194 such that fluid may flow therebetween and into storage tank 12. In one embodiment, drain valve 216 may include a lever (not shown) coupled to a pull member, such as chain 222, to actuate the drain valve 216. In this way, when the chain 222 is pulled proximally, the valve element 218 may be moved distally and away from the valve seat 220 so as to open the drain valve 216. The chain 222 may be coupled to a hook 224 coupled to the cover 78, such as along mounting ring 80, so that an operator may easily grasp the chain 222 and actuate the drain valve 216. The primary base 152 may include a catch portion 226 formed therein defining a passageway 228 in fluid communication with passageway 176 in central tube 168. Those of ordinary skill in the art will recognize that the drain valve 216 may be omitted when spill bucket 30 is used on the vapor side of the fill operation.

The bottom wall 208 of primary base 152 may also include an access port 230 (e.g., threaded or unthreaded) that opens into the second interior cavity 104 of the secondary spill container 36. In one embodiment, a plug (not shown) may be disposed in the access port 230 to seal the port in a fluid tight manner. In another embodiment, however, a product float 232 (FIG. 2) may be coupled to the access port 230. The product float 232 may be a conventional float, such as those available from Kelch of Menomonee Falls, Wis. In any event, the product float 232 is adapted to provide a visual indication to an operator, that has removed the cover plate 82 and accessed the primary spill container 34, whether there is any liquid (e.g., water, fuel, etc.) in the secondary spill container 36. Those of ordinary skill in the art will further recognize that other types of devices may be used to indicate whether there is any liquid in the secondary spill container 36.

Figure 7:
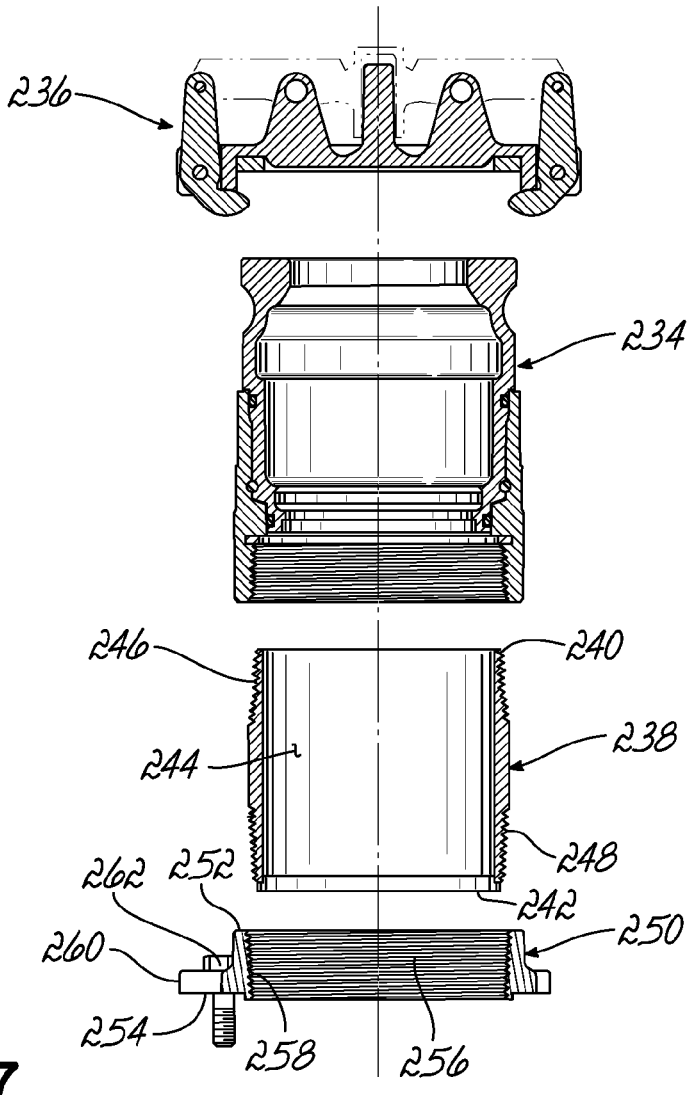
FIG. 7 is a disassembled, cross-sectional view of access structure of the spill bucket shown in FIG. 2.

A number of conventional components are typically used to facilitate coupling of the riser pipe 22/fill tube 194 with an end of a supply hose from a tanker truck (not shown) such as during a fill operation. In this regard, and as is conventional, an adaptor, such as swivel adaptor 234, and cap 236 may be used to seal the riser pipe 22 (and fill tube 194) during periods of normal operation of the fuel dispensing system 10, and to facilitate coupling to the supply hose of the tanker truck during a fill operation. As shown in FIGS. 2 and 7, these components may be coupled to the riser pipe 22 using a generally elongate, tubular nipple 238. More particularly, the nipple 238 has a proximal end 240, a distal end 242, and a passageway 244 extending therebetween. The proximal end 240 includes a set of external threads 246 for threadably coupling to the swivel adaptor 234.

The distal end 242 of the nipple 238 also includes a set of external threads 248 adapted to be coupled to the primary base 152 of the primary spill container 34. In one embodiment, this coupling may be achieved using a nipple adaptor 250 that facilitates coupling of the nipple 238 to the primary base 152 in an improved manner. In this regard, adaptor 250 includes a proximal end 252, a distal end 254, and a passageway 256 extending therebetween. The proximal end 252 of adaptor 250 includes a set of internal threads 258 configured to cooperate with the external threads 248 on the distal end 242 of the nipple 238 so as to threadably couple the nipple 238 to adaptor 250. Alternatively, the nipple 238 and adaptor 250 may be formed as a unitary structure. The distal end 254 of adaptor 250 is configured to abut the bottom wall 208 of basin 170 of the primary base 152. To secure the adaptor 250 to primary base 152, adaptor 250 may include a radially-extending flange 260 having a plurality of circumferentially-spaced bores (not shown) that align with a corresponding set of circumferentially-spaced threaded bores (not shown) in the bottom wall 208 of basin 170. The bores receive a threaded fastener 262 to secure the adaptor 250 to the primary base 152. In one embodiment, the flange 260 may extend around the full periphery of adaptor 250. Alternatively, adaptor 250 may include a plurality of circumferentially-spaced, radially-extending tabs (not shown) that include the bores for securing the adaptor 250 to the primary base 152. To maintain a fluid tight seal between the adaptor 250 and primary base 152, the bottom wall 208 of basin 170 may include a groove 264 configured to receive an O-ring 266 or other known type of seal. Those of ordinary skill in the art will recognize other arrangements for sealing this coupling. By way of example, the adaptor 250 may include an extension portion that extends into the passageway 176 of central tube 168 and the seal may be formed between the passageway 176 and the side wall of the extension portion using an O-ring or other known type of seal.

In use, when it is desired to add fuel to the storage tank 12, an operator will remove the cover plate 82 to access the primary interior cavity 154, which contains the structure, such as the swivel adaptor 234 and cap 236, for accessing the riser pipe 22 (and fill tube 194). The operator will remove the cap 236 and couple an end of a supply hose to the swivel adaptor 234. Fuel will then be permitted to flow from the tanker truck, through the supply hose, and into the fill tube 194 disposed in riser pipe 22 via the passageways of the intervening structure (e.g., nipple 238, passageway 176, etc.). If fuel is inadvertently spilled during the fill operation, such as from the supply hose or from the riser pipe 22, the fuel will flow into the primary interior cavity 154 of the primary spill container 34 and be contained therein. The spilled fuel in cavity 154 may be directed to the storage tank 12 by pulling on the chain 222, which opens drain valve 216 so that the fuel may flow into storage tank 12.

If for some reason, the primary spill container 34 would fail, such as by developing a hole, crack, etc., and thereby not be effective to contain spilled fuel, the fuel would flow into the secondary interior cavity 104 of the secondary spill container 36 and be contained therein. The fuel that flows into the secondary interior cavity 104 would be detected by the product float 232 or other monitoring device and thereby provide the operator with an indication that containment by the primary spill container 34 has been breached and repair and/or replacement thereof may be required.

The spill bucket 30 as described herein includes a number of advantageous features that improve the operation and/or functionality of spill bucket 30 and may further prove advantageous in other spill bucket designs (e.g., single containment designs) as well. For example, one feature that provides increased functionality is the socket 128 adjacent the distal end of the spill bucket 30. Conventional spill buckets are generally difficult for maintenance personnel and installers to couple to the proximal end of the riser pipe 22. This may be contributed to the fact that spill buckets are generally heavy (e.g., 150 lbs or more), are installed or replaced in limited working space, and that the threads on conventional spill buckets for coupling to the threads on the riser pipe are typically at the distal most end of the spill bucket. The latter fact results in the relatively heavy spill bucket having to be lifted and balanced just right by maintenance personnel in order to get the threaded connection started. This can be a difficult, frustrating, costly, and time-consuming task.

To address such a shortcoming in conventional spill buckets, spill bucket 30 described herein includes the socket 128 having the threaded connection that couples with the threaded riser pipe 22 proximal of the distal end of the spill bucket 30. Such a configuration essentially allows the spill bucket 30 to be seated on and supported by the riser pipe 22 as the threaded connection is initiated. The socket 128 provides for balancing the spill bucket 30 on the riser pipe 22 so that only the threads must be engaged to complete the coupling. Such a feature makes installation significantly easier, less costly, and more time and labor efficient.

Although the socket feature is shown and described herein in the context of double-walled spill bucket 30, it should be recognized that such a feature is not so limited. In this regard, the socket feature may be beneficial in single containment spill bucket designs, multi-port bucket designs, as well as possibly other fuel dispensing components.

The socket 128 may provide advantages in addition to those described above. In this regard, many state and federal regulations are requiring double containment devices for fuel handling systems. Thus, as older single containment spill buckets are replaced, it may be required to replace them with a double-walled containment spill bucket. Due to the double containment design, however, such spill buckets are typically longer than their single containment spill bucket counterparts. Accordingly, double-walled spill buckets having conventionally placed threads (i.e., no socket) would, if simply threaded back on the same or existing riser pipe, extend above the ground or drive surface 70 and present a potential hazard or obstacle on the drive surface 70. To accommodate the extra length then, the riser pipe has to be replaced or shortened so that the proximal end of the double-walled spill bucket is substantially flush with the drive surface 70. Such replacement or modification of the riser pipe is costly, time-consuming and labor intensive. In contrast to this, however, the socket feature as illustrated in spill bucket 30 allows the proximal end of the spill bucket to remain flush with the drive surface 70 while using the existing riser pipe, i.e., without replacement or major modifications thereto. In this regard, the extra length for the double-walled construction is located distally of the proximal end of the riser pipe to effectively create the socket. This configuration then provides for replacement with double-walled bucket designs without the need for extensive replacement or modification to the existing riser pipe.

Another feature that provides improved functionality is the connection between the nipple 238 and the spill bucket 30. In many conventional spill bucket designs, the nipple is coupled to a collar (similar to nipple adaptor 250) that is rigidly or permanently affixed to the spill bucket (e.g., to the base of the spill container). Thus for installation, the nipple must be inserted into the interior of the spill bucket and threadably coupled to the fixed collar. Such a configuration provides limited space for which to get tools (e.g., pipe wrench, etc.) around the nipple so as to provide a tight connection with the collar. Similarly, for maintenance reasons, it may be necessary to remove the nipple from the spill bucket. For example, to repair and or replace the fill tube, jack screw, or other components distal of the nipple, the nipple must be removed. To do so again requires an operator to get a tool in a limited work space to unthread the nipple from the collar. To do so typically is difficult, time-consuming, and labor intensive.

To address such a shortcoming in conventional spill buckets, spill bucket 30 described herein includes a more modular design that replaces the permanently affixed collar with a removable adaptor 250 that couples with the spill bucket 30 via threaded fasteners 262 that are easily accessed and manipulated by a suitable tool. For example, during installation, the nipple 238 and any structure coupled thereto (e.g., swivel adaptor 234 and cap 236) may be pre-assembled with adaptor 250. Such pre-assembly may occur outside of the spill bucket 30 and provide improved working space as well as tool access. Once assembled, this sub-assembly may be inserted into the spill bucket 30 and coupled thereto via the threaded fasteners 262 in a comparatively simplified manner.

Furthermore, to provide replacement or repair to components that require removal of the nipple 238, the threaded fasteners 262 may simply be removed so as to remove the sub-assembly and gain access to the desired components. Such a design between the connection of the nipple 238 and spill bucket 30 allows installation, replacement, and/or repair to be performed in a more cost effective, time efficient, and labor efficient manner.

Similar to the socket feature, the improved connection between the nipple 238 and spill bucket 30 via the adaptor 250 should not be limited to the double-walled construction provided herein. Instead, it should be recognized that such an adaptor may be beneficial in single containment spill bucket designs, multi-port bucket designs, as well as other fuel dispensing components.

Still another feature that provides improved functionality is the connection between the fill tube 194 and the riser pipe 22. In many conventional spill bucket designs, the flange 202 of the fill tube 194 is adapted to engage the proximal end face of the riser pipe 22. The coupling is typically sealed using an O-ring or other known seal between the flange 202 and the proximal end face of the riser pipe 22. In many cases, however, the proximal end face of the riser pipe 22 does not provide a surface conducive to sealing, but instead is often times rough and uneven. Consequently, the seal between the fill tube 194 and riser pipe 22 is unreliable or ineffective. Moreover, the replacement of the seal is difficult, costly, time-consuming and labor intensive.

To address such a shortcoming in conventional spill buckets, spill bucket 30 described herein provides for improved sealing between the fill tube 194 and the riser pipe 22. As discussed above and shown in FIGS. 2 and 5, the flange 202 of the fill tube 194 no longer engages the proximal end face of the riser pipe 22, but instead, engages seat 200 in ring 188 in the primary base 152. Relocating fill tube engagement to seat 200 provides for a prepared surface (e.g., smooth and even) that engages with flange 202 in an improved manner. In this way, the O-ring 204 or other seal has a smooth, even surface to engage that creates a more reliable and effective seal. In addition, an improved seal may also be attained between the riser pipe 22 and the primary base 152. In this regard, the secondary base 102 is threadably coupled to the riser pipe 22 and the primary base 152 is coupled to the secondary base 102. As previously discussed, secondary base 102 includes a groove 184 for receiving O-ring 186 that creates a seal with passageway 176 of central tube 168. Similar to above, these surfaces may be prepared to enhance the sealing with O-ring 186. Such a configuration for forming a seal between fill tube 194 and riser pipe 22 eliminates the need to create a seal on a potentially very rough and uneven surface. Accordingly, the sealing is more reliable and effective.

While the present invention has been illustrated by a description of various preferred embodiments and while these embodiments have been described in some detail, it is not the intention of the Applicants to restrict or in any way limit the scope of the appended claims to such detail. Additional advantages and modifications will readily appear to those skilled in the art. Thus, the various features of the invention may be used alone or in numerous combinations depending on the needs and preferences of the user.

What is claimed is:

1. A spill containment apparatus for containing liquid spillage from a fill operation, comprising:

a container including a central tube having a passageway for receiving an end of a riser pipe of a storage tank, a nipple adapted to carry access structure for accessing the riser pipe with a supply hose; and an adaptor having a first end configured to be removably coupled to the container and a second end configured to be coupled to the nipple, the adaptor spaced from the central tube, wherein the nipple is configured to be selectively assembled to and removed from the container by respectively coupling or removing the adaptor from the container.

2. The spill containment apparatus of claim 1, wherein the adaptor includes one or more fasteners for coupling the adaptor to the container, the one or more fasteners being accessible by a tool for manipulation thereof.

3. The spill containment apparatus of claim 1, wherein the access structure includes at least one of an adaptor and a cap.

4. The spill containment apparatus of claim 1, wherein the container comprises:

a primary spill container; and a secondary spill container, wherein the primary spill container is disposed at least in part in the secondary spill container to provide redundancy to liquid spillage containment.

5. The spill containment apparatus of claim 4, wherein the primary spill container includes a primary body coupled to a primary base and the secondary spill container includes a secondary body coupled to a secondary base, the secondary base adapted to be coupled to the riser pipe and the primary base adapted to be coupled to the secondary base, the adaptor being coupled to the primary base.

6. The spill containment apparatus of claim 4, further comprising:

an outer sump housing adapted to contain at least in part the primary and secondary containers, the outer sump housing including a cover for accessing the access structure carried by the nipple.

7. The spill containment apparatus of claim 1, wherein the containment apparatus is one of a double-walled, single-walled, or multi-port design.

8. A method of assembling a spill containment apparatus for containing liquid spillage from a fill operation, comprising:

coupling an end of a riser pipe of a storage tank to a container including a central tube having a passageway for receiving the riser pipe, coupling a nipple to a removable adaptor external of the container, the nipple adapted to carry access structure for accessing the riser pipe with a supply hose; and coupling the adaptor to the container such that the central tube is spaced from the adaptor.

9. The method of claim 8 further comprising:

performing maintenance on the spill apparatus, comprising removing the adaptor carrying the nipple from the container to expose a component for repair or replacement.

10. A spill containment apparatus for containing liquid spillage from a fill operation, comprising:

a primary spill container;

a secondary spill container adapted to be coupled to an end of a riser pipe of a storage tank and situated relative to the primary spill container such that the primary spill container is disposed at least in part in the secondary spill container to provide redundancy to liquid spillage containment;

a nipple adapted to carry access structure for accessing the riser pipe with a supply hose; and an adaptor having a first end configured to be removably coupled to the primary spill container and a second end configured to be coupled to the nipple, wherein the nipple is configured to be selectively assembled to and removed from the container primary spill by respectively coupling or removing the adaptor from the primary spill container.

11. The spill containment apparatus of claim 10, wherein the primary spill container includes a primary body coupled to a primary base and the secondary spill container includes a secondary body coupled to a secondary base, the secondary base adapted to be coupled to the riser pipe and the primary base adapted to be coupled to the secondary base, the adaptor being coupled to the primary base.

12. The spill containment apparatus of claim 10, further comprising:

an outer sump housing adapted to contain at least in part the primary and secondary containers, the outer sump housing including a cover for accessing the access structure carried by the nipple.

13. A spill containment apparatus for containing liquid spillage from a fill operation, comprising:

a primary spill container;

a secondary spill container adapted to be coupled to an end of a riser pipe of a storage tank and situated relative to the primary spill container such that the primary spill container is disposed at least in part in the secondary spill container to provide redundancy to liquid spillage containment;

a nipple adapted to carry access structure for accessing the riser pipe with a supply hose; and an adaptor having a first end configured to be removably coupled to the primary spill container and a second end configured to be coupled to the nipple such that the adaptor and nipple are removable from the primary spill container without the primary spill container being removed from the secondary spill container.

14. The spill containment apparatus of claim 13, wherein the primary spill container includes a primary body coupled to a primary base and the secondary spill container includes a secondary body coupled to a secondary base, the secondary base adapted to be coupled to the riser pipe and the primary base adapted to be coupled to the secondary base, the adaptor being coupled to the primary base.

15. The spill containment apparatus of claim 13, further comprising:

an outer sump housing adapted to contain at least in part the primary and secondary containers, the outer sump housing including a cover for accessing the access structure carried by the nipple.

* * * * *

UNITED STATES PATENT AND TRADEMARK OFFICE

CERTIFICATE OF CORRECTION

PATENT NO. : 8,622,097 B2
APPLICATION NO. : 12/394171
DATED : January 7, 2014
INVENTOR(S) : Kristopher A. Kane et al.

It is certified that error appears in the above-identified patent and that said Letters Patent is hereby corrected as shown below:

In the Claims

CLAIM 10

Column 13, lines 2-3, "the container primary spill" should be --the primary spill container--

Signed and Sealed this
Twenty-first Day of October, 2014

Michelle K. Lee

Michelle K. Lee
*Deputy Director of the United States Patent and Trademark Office*